US009581422B2

(12) United States Patent
Preiss et al.

(10) Patent No.: US 9,581,422 B2
(45) **Date of Patent: *Feb. 28, 2017**

(54) PERFORATING GUN AND DETONATOR ASSEMBLY

(71) Applicant: DynaEnergetics GmbH & Co. KG, Troisdorf (DE)

(72) Inventors: Frank Haron Preiss, Bonn (DE); Thilo Scharf, Letterkenny (IE); Liam McNelis, Bonn (DE)

(73) Assignee: DynaEnergetics GmbH & Co. KG, Troisdorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/932,865

(22) Filed: Nov. 4, 2015

(65) Prior Publication Data

US 2017/0030693 A1 Feb. 2, 2017

Related U.S. Application Data

(63) Continuation of application No. 14/767,058, filed as application No. PCT/EP2014/065752 on Jul. 22, 2014.

(30) Foreign Application Priority Data

Aug. 26, 2013 (DE) ..... 10 2013 109 227

(51) Int. Cl.
*F42C 19/12* (2006.01)
*E21B 43/1185* (2006.01)

(52) U.S. Cl.
CPC ..... *F42C 19/12* (2013.01); *E21B 43/1185* (2013.01)

(58) Field of Classification Search
USPC ..... 89/1.15, 1.151; 102/301, 312, 313, 372; 175/4.54, 4.55; 166/55
See application file for complete search history.

(56) References Cited

U.S. PATENT DOCUMENTS 3,504,723 A 4/1970 Cushman et al.
4,182,216 A 1/1980 DeCaro
(Continued)

FOREIGN PATENT DOCUMENTS

CA 2821506 A1 1/2015
WO WO-0159401 A1 8/2001
(Continued)

OTHER PUBLICATIONS

Dynaenergetics, Selective Perforating Switch, information downloaded from website, Jul. 3, 2013, http://www.dynaenergetics.com/.
(Continued)

*Primary Examiner* — Bret Hayes
(74) *Attorney, Agent, or Firm* — Lisa J. Moyles; Janelle A. Bailey

(57) ABSTRACT

According to an aspect, a perforating gun assembly and a detonator assembly are provided. The detonator assembly includes at least a shell, and more than one electrically contactable component that is configured for being electrically contactably received by the perforating gun assembly without using a wired electrical connection, but rather forms the electrical connection merely by contact with at least one of the more than one electrically contactable components. According to an aspect, the detonator assembly includes a selective detonator assembly. A method of assembling the perforating gun assembly including the detonator assembly is also provided.

15 Claims, 4 Drawing Sheets

(56) References Cited

U.S. PATENT DOCUMENTS

| | | | | |
|---|---|---|---|---|
| 4,574,892 | A | 3/1986 | Grigar et al. | |
| 5,027,708 | A * | 7/1991 | Gonzalez | F42D 1/04 102/202.1 |
| 5,088,413 | A * | 2/1992 | Huber | F42B 3/124 102/200 |
| 5,105,742 | A | 4/1992 | Sumner | |
| 5,347,929 | A * | 9/1994 | Lerche | E21B 43/1185 102/202.14 |
| 6,085,659 | A | 7/2000 | Beukes et al. | |
| 6,418,853 | B1 | 7/2002 | Duguet et al. | |
| 7,193,527 | B2 * | 3/2007 | Hall | G01V 11/002 175/40 |
| 7,347,278 | B2 * | 3/2008 | Lerche | E21B 41/00 102/215 |
| 7,568,429 | B2 | 8/2009 | Hummel et al. | |
| 7,762,172 | B2 | 7/2010 | Li et al. | |
| 7,778,006 | B2 | 8/2010 | Stewart et al. | |
| 7,810,430 | B2 | 10/2010 | Chan et al. | |
| 7,929,270 | B2 | 4/2011 | Hummel et al. | |
| 8,069,789 | B2 * | 12/2011 | Hummel | F42B 3/103 102/202.12 |
| 8,074,737 | B2 | 12/2011 | Hill et al. | |
| 8,157,022 | B2 | 4/2012 | Bertoja et al. | |
| 8,182,212 | B2 | 5/2012 | Parcell | |
| 8,256,337 | B2 * | 9/2012 | Hill | E21B 43/1185 89/1.15 |
| 8,395,878 | B2 | 3/2013 | Stewart et al. | |
| 8,875,787 | B2 | 11/2014 | Tassaroli | |
| 8,881,816 | B2 | 11/2014 | Glenn et al. | |
| 2002/0020320 | A1 | 2/2002 | Lebaudy et al. | |
| 2002/0062991 | A1 | 5/2002 | Farrant et al. | |
| 2003/0000411 | A1 * | 1/2003 | Cernocky | E21B 43/1185 102/200 |
| 2003/0001753 | A1 | 1/2003 | Cernocky et al. | |
| 2005/0178282 | A1 | 8/2005 | Brooks et al. | |
| 2007/0158071 | A1 | 7/2007 | Mooney, Jr. et al. | |
| 2008/0173204 | A1 | 7/2008 | Anderson et al. | |
| 2009/0050322 | A1 | 2/2009 | Hill et al. | |
| 2010/0230104 | A1 | 9/2010 | Nolke et al. | |
| 2012/0199031 | A1 * | 8/2012 | Lanclos | E21B 43/1185 102/206 |
| 2012/0242135 | A1 | 9/2012 | Thomson et al. | |
| 2012/0247771 | A1 * | 10/2012 | Black | E21B 43/1185 166/297 |

FOREIGN PATENT DOCUMENTS

| | | | |
|---|---|---|---|
| WO | WO-2009091422 | A2 | 7/2009 |
| WO | WO-2015006869 | A1 | 1/2015 |

OTHER PUBLICATIONS

Dynaenergetics, Selective Perforating Switch, Product Information Sheet, May 27, 2011.

Dynaenergetics, Electronic Top Fire Detonator, Product Information Sheet, Jul. 30, 2013.

PCT Search Report and Written Opinion, mailed May 4, 2015: See Search Report and Written opinion for PCT Application No. PCT/EP2014/065752.

Hunting Titan, Wireline Top Fire Detonator Systems, Product Info Sheet.

Dynaenergetics, DYNAselect System, information downloaded from website, Jul. 3, 2013, http://www.dynaenergetics.com/.

Jim Gilliat/Khaled Gasmi, New Select-Fire System, Baker Hughes, Presentation—2013 Asia-Pacific Perforating Symposium, Apr. 29, 2013.

Dynaenergetics, DYNAselect Electronic Detonator 0015 SFDE RDX 1.4S, Product Information, Dec. 16, 2011.

Dynaenergetics, DYNAselect Electronic Detonator 0015 SFDE RDX 1.4B, Product Information, Dec. 16, 2011.

Dynaenergetics, Gun Assembly, Products Summary Sheet, May 7, 2004.

* cited by examiner

PERFORATING GUN AND DETONATOR ASSEMBLY

CROSS-REFERENCE TO RELATED APPLICATIONS

This application is a Continuation Application of U.S. application Ser. No. 14/767,058 filed Aug. 11, 2015, and claims priority to PCT Application No. PCT/EP2014/065752 filed Jul. 22, 2014, which claims priority to German Patent Application No. 102013109227.6 filed Aug. 26, 2013, each of which is incorporated herein by reference in its entirety.

FIELD

Devices and methods for selective actuation of wellbore tools are generally described. In particular, devices and methods for selective arming of a detonator assembly of a perforating gun assembly are generally described.

BACKGROUND

Hydrocarbons, such as fossil fuels (e.g. oil) and natural gas, are extracted from underground wellbores extending deeply below the surface using complex machinery and explosive devices. Once the wellbore is established by placement of cases after drilling, a perforating gun assembly, or train or string of multiple perforating gun assemblies, are lowered into the wellbore, and positioned adjacent one or more hydrocarbon reservoirs in underground formations. The perforating gun has explosive charges, typically shaped, hollow or projectile charges, which are ignited to create holes in the casing and to blast through the formation so that the hydrocarbons can flow through the casing. Once the perforating gun(s) is properly positioned, a surface signal actuates an ignition of a fuse, which in turn initiates a detonating cord, which detonates the shaped charges to penetrate/perforate the casing and thereby allow formation fluids to flow through the perforations thus formed and into a production string. The surface signal typically travels from the surface along electrical wires that run from the surface to one or more detonators positioned within the perforating gun assembly.

Assembly of a perforating gun requires assembly of multiple parts, which typically include at least the following components: a housing or outer gun barrel within which is positioned an electrical wire for communicating from the surface to initiate ignition, a percussion initiator and/or a detonator, a detonating cord, one or more charges which are held in an inner tube, strip or carrying device and, where necessary, one or more boosters. Assembly typically includes threaded insertion of one component into another by screwing or twisting the components into place, optionally by use of a tandem adapter. Since the electrical wire must extend through much of the perforating gun assembly, it is easily twisted and crimped during assembly. In addition, when a wired detonator is used it must be manually connected to the electrical wire, which has lead to multiple problems. Due to the rotating assembly of parts, the wires can become torn, twisted and/or crimped/nicked, the wires may be inadvertently disconnected, or even mis-connected in error during assembly, not to mention the safety issues associated with physically and manually wiring live explosives.

According to the prior art and as shown in FIG. 1, the wired detonator 60 has typically been configured such that wires must be physically, manually connected upon configuration of the perforating gun assembly. As shown herein, the wired detonator 60 typically has three (or more) wires, (although it is possible to have one or more wires whereby one wire could also be a contact (as described in greater detail below and as found, for instance, in a spring-contact detonator, commercially available from DynaEnergetics GmbH & Co. KG without the benefit of selectivity) and whereby a second connection would be through a shell or head of the detonator), which require manual, physical connection once the wired detonator is placed into the perforating gun assembly. For detonators with a wired integrated switch for selective perforating, the wires typically include at least a signal-in wire 61, a signal-out wire 62 and a ground wire 63, while it is possible that only two wires are provided and the third or ground connection is made by connecting the third wire to the shell or head of the. In a typical manual, physical connection, the wires extending along the perforating gun are matched to the wires of the detonator, and an inner metallic portion of one wire is twisted together with an inner metallic portion of the matched wire using an electrical connector cap or wire nut or a scotch-lock type connector.

The detonator assembly described herein does away with the wired connection by providing a wirelessly-connectable, selective detonator, more specifically, a detonator configured to be received within a detonator positioning assembly through a wireless connection—that is, without the need to attach wires to the detonator. For the sake of clarity, the term "wireless" does not refer to a WiFi connection. The detonator assembly described herein solves the problems associated with the wired detonator of the prior art in that it is simple to assemble and is almost impossible to falsely connect.

BRIEF DESCRIPTION

An embodiment provides a wirelessly-connectable selective detonator assembly configured for being electrically contactably received within a perforating gun assembly without using a wired electrical connection according to claim 1.

Another embodiment provides a perforating gun assembly including the wirelessly-connectable selective detonator assembly and a detonator positioning assembly according to the independent assembly claim.

Another embodiment provides a method of assembling the perforating gun assembly according to the independent method claim.

BRIEF DESCRIPTION OF THE FIGURES

A more particular description briefly described above will be rendered by reference to specific embodiments thereof that are illustrated in the appended drawings. Understanding that these drawings depict only typical embodiments and are not therefore to be considered to be limiting of its scope, exemplary embodiments will be described and explained with additional specificity and detail through the use of the accompanying drawings in which.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to embodiments.

DETAILED DESCRIPTION

Reference will now be made in detail to embodiments. Each example is provided by way of explanation, and is not meant as a limitation and does not constitute a definition of all possible embodiments.

In an embodiment, a detonator assembly is provided that is capable of being positioned or placed into a perforating gun assembly with minimal effort, by means of placement/positioning within a detonator positioning assembly. In an embodiment, the detonator positioning assembly includes the detonator assembly positioned within the detonator positioning assembly, which is positioned within the perforating gun assembly. The detonator assembly electrically contactably forms an electrical connection without the need of manually and physically connecting, cutting or crimping wires as required in a wired electrical connection. Rather, the detonator assembly described herein is a wirelessly-connectable selective detonator assembly.

In an embodiment, the detonator assembly is particularly suited for use with a modular perforating gun assembly as described in a Canadian Patent Application No. 2,824,838 filed Aug. 26, 2013, entitled PERFORATION GUN COMPONENTS AND SYSTEM, (hereinafter "the Canadian Application"), which is incorporated herein by reference in its entirety. The Canadian Application describes a modular-type perforating gun which means that at least some of the components are typically snapped, clicked, or plugged together, rather than screwed, twisted or rotated together as discussed above. That is, the modular perforating gun includes components that are fit together using studs or pins protruding from one component, that are frictionally fit into recessed areas or sockets in an adjoining component.

As used herein, the term "wireless" means that the detonator assembly itself is not manually, physically connected within the perforating gun assembly as has been traditionally done with wired connections, but rather merely makes electrical contact through various components as described herein to form the electrical connections. Thus, the signal is not being wirelessly transmitted, but is rather being relayed through electrical cables/wiring within the perforating gun assembly through the electrical contacts.

Figure 1:
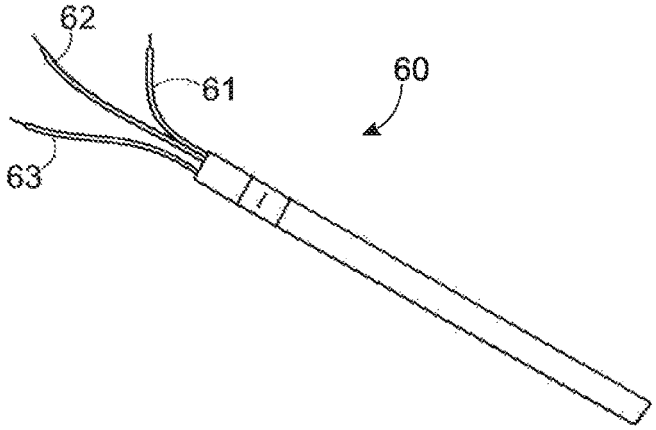
Prior Art FIG. 1
FIG. 1 is a perspective view of a wired detonator according to the prior art.
Figure 2:
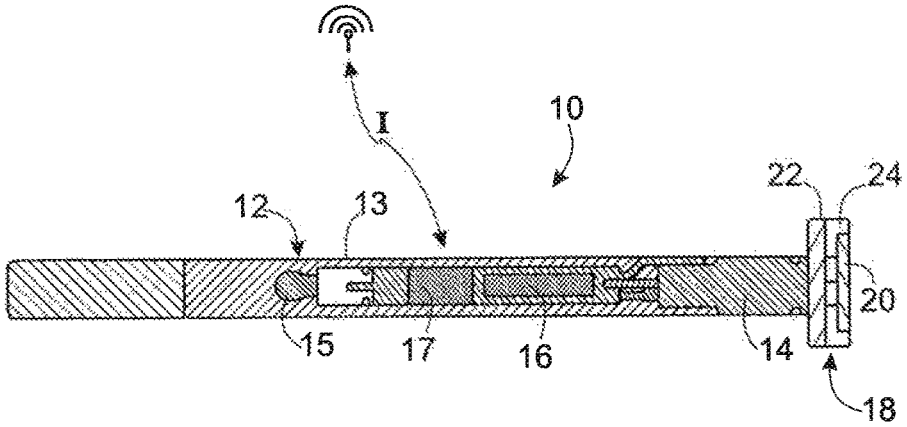
FIG. 2 is a cross-sectional side view of a wirelessly-connectable selective detonator assembly according to an aspect.
Figure 3:
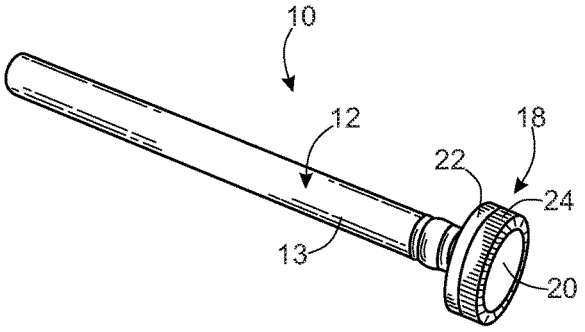
FIG. 3 is a perspective view of the detonator assembly according to FIG. 1.

Now referring to FIGS. 2 and 3, according to an embodiment, a wirelessly-connectable selective detonator assembly 10 is provided for use in a perforating gun assembly 40. The detonator assembly 10 includes a detonator shell 12 and a detonator head 18 and is configured for being electrically contactably received within a perforating gun assembly 40 without using a wired electrical connection, that is without connecting one or more wires directly to the detonator assembly 10.

In an embodiment, the detonator shell 12 is configured as a housing or casing, typically a metallic, which houses at least a detonator head plug 14, a fuse head 15, an electronic circuit board 16 and explosive components. According to one aspect, the fuse head 15 could be any device capable of converting an electric signal into an explosion. In an embodiment shown in FIG. 2, the detonator shell 12 is shaped as a hollow cylinder. The electronic circuit board 16 is connected to the fuse head 14 and is configured to allow for selective detonation of the detonator assembly 10. In an embodiment, the electronic circuit board 16 is configured to wirelessly and selectively receive an ignition signal I, (typically a digital code uniquely configured for a specific detonator), to fire the perforating gun assembly 40. By "selective" what is meant is that the detonator assembly is configured to receive one or more specific digital sequence(s), which differs from a digital sequence that might be used to arm and/or detonate another detonator assembly in a different, adjacent perforating gun assembly, for instance, a train of perforating gun assemblies. So, detonation of the various assemblies does not necessarily have to occur in a specified sequence. Any specific assembly can be selectively detonated. In an embodiment, the detonation occurs in a down-up or bottom-up sequence.

The detonator head 18 extends from one end of the detonator shell 12, and includes more than one electrical contacting component including an electrically contactable line-in portion 20 and an electrically contactable line-out portion 22, according to an aspect. According to one aspect, the detonator assembly 10 may also include an electrically contactable ground portion 13. In an embodiment, the detonator head 18 may be disk-shaped. In another embodiment, at least a portion of the detonator shell 12 is configured as the ground portion 13. The line-in portion 20, the line-out portion 22 and the ground portion 13 are configured to replace the wired connection of the prior art wired detonator 60 and to complete the electrical connection merely by contact with other electrical contacting components. In this way, the line-in portion 20 of the detonator assembly 10 replaces the signal-in wire 61 of the wired detonator 60, the line-out portion 22 replaces the signal-out wire 62 and the ground portion 13 replaces the ground wire 63. Thus, when placed into a detonator positioning assembly 30 (see FIG. 4) as discussed in greater detail below, the line-in portion 20, the line-out portion 22 and the ground portion 13 of the detonator assembly 10 make an electrical connection by merely making contact with corresponding electrical contacting components (also as discussed in greater detail below). That is, the detonator assembly 10 is wirelessly connectable only by making and maintaining electrical contact of the electrical contacting components to replace the wired electrical connection and without using a wired electrical connection.

The detonator head 18 also includes an insulator 24, which is positioned between the line-in portion 20 and the line-out portion 22. The insulator 24 functions to electrically isolate the line-in portion 20 from the line-out portion 22. Insulation may also be positioned between other lines of the detonator head. As discussed above and in an embodiment, it is possible for all of the contacts to be configured as part of the detonator head 18 (not shown), as found, for instance, in a banana connector used in a headphone wire assembly in which the contacts are stacked longitudinally along a central axis of the connector, with the insulating portion situated between them.

In an embodiment, a capacitor 17 is positioned or otherwise assembled as part of the electronic circuit board 16. The capacitor 17 is configured to be discharged to initiate the detonator assembly 10 upon receipt of a digital firing sequence via the ignition signal I, the ignition signal being electrically relayed directly through the line-in portion 20 and the line-out portion 22 of the detonator head 18. In a typical arrangement, a first digital code is transmitted downhole to and received by the electronic circuit board. Once it is confirmed that the first digital code is the correct code for that specific detonator assembly, an electronic gate is closed and the capacitor is charged. Then, as a safety feature, a second digital code is transmitted to and received by the electronic circuit board. The second digital code, which is also confirmed as the proper code for the particular detonator, closes a second gate, which in turn discharges the capacitor via the fuse head to initiate the detonation.

In an embodiment, the detonator assembly 10 may be fluid disabled. "Fluid disabled" means that if the perforating gun has a leak and fluid enters the gun system then the detonator is disabled by the presence of the fluid and hence the explosive train is broken. This prevents a perforating gun from splitting open inside a well if it has a leak and plugging the wellbore, as the hardware would burst open. In an embodiment, the detonator assembly 10 is a selective fluid disabled electronic (SFDE) detonator assembly.

The detonator assembly 10 according to an aspect can be either an electric or an electronic detonator. In an electric detonator, a direct wire from the surface is electrically contactingly connected to the detonator assembly and power is increased to directly initiate the fuse head. In an electronic detonator assembly, circuitry of the electronic circuit board within the detonator assembly is used to initiate the fuse head.

In an embodiment, the detonator assembly 10 may be immune, that is, will not unintentionally fire or be armed by stray current or voltage and/or radiofrequency (RF) signals to avoid inadvertent firing of the perforating gun. Thus, in this embodiment, the assembly is provided with means for ensuring immunity to high stray current or voltage and/or RF signals, such that the detonator assembly 10 is not initiated through random radio frequency signals, stray voltage or stray current. In other words, the detonator assembly 10 is configured to avoid unintended initiation and would fail safe.

Figure 4:
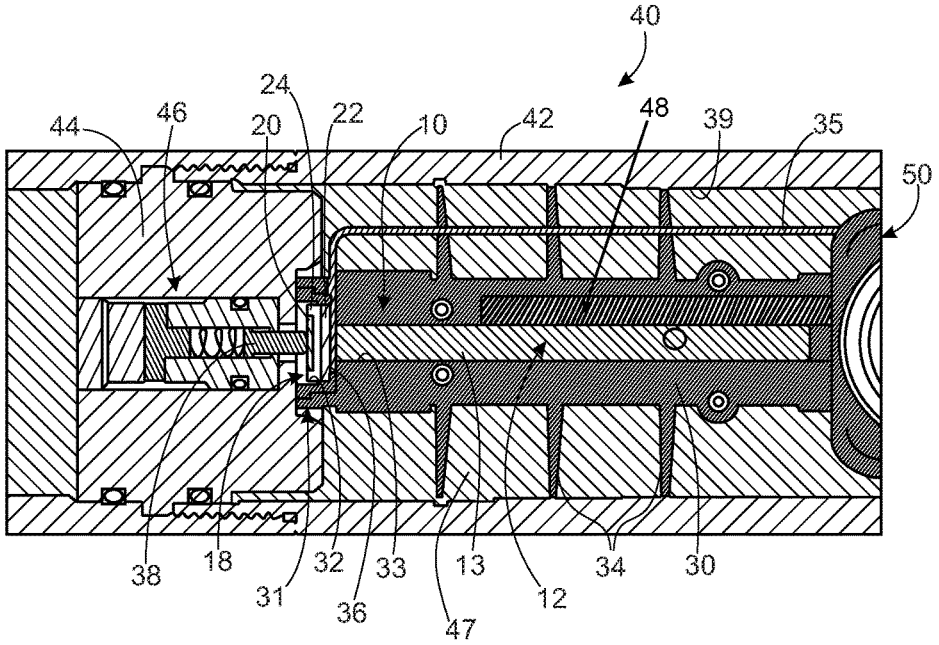
FIG. 4 is a partial cross-sectional side view a perforating gun assembly including the detonator assembly seated within a detonator positioning assembly according to an aspect.
Figure 5:
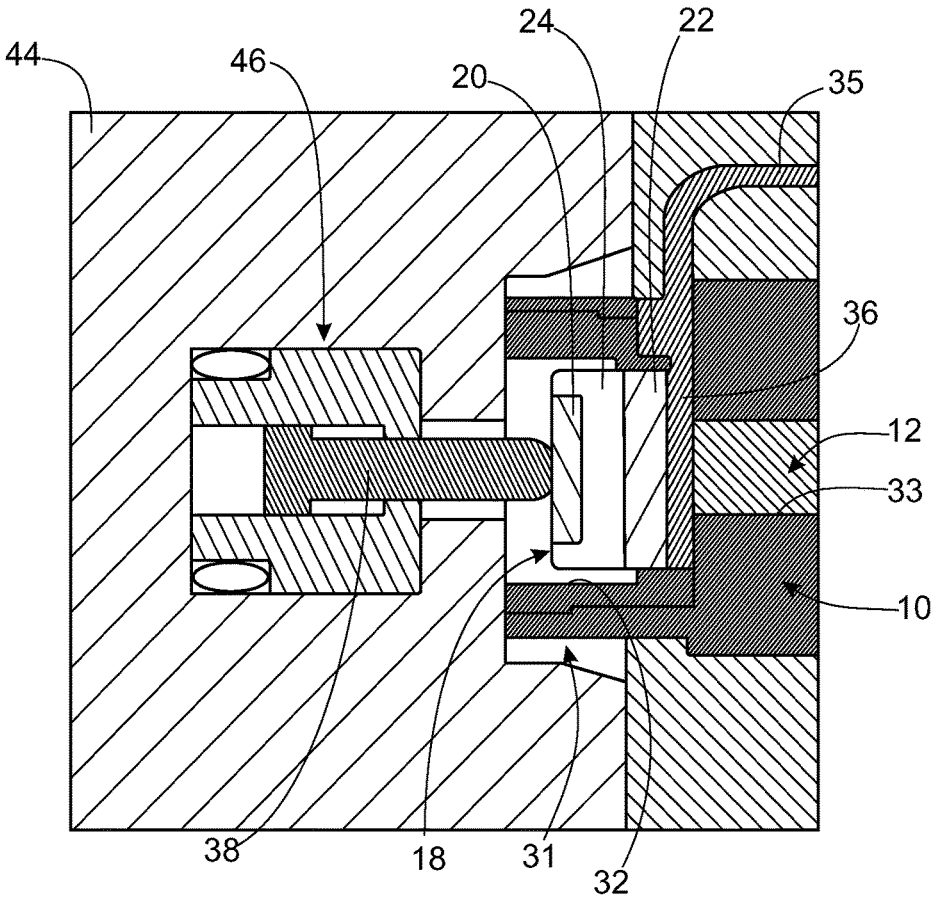
FIG. 5 is an exploded cross-sectional side view of FIG. 4 showing an electrically contactingly electrical connection without using a wired electrical connection according to an aspect.
Figure 6:
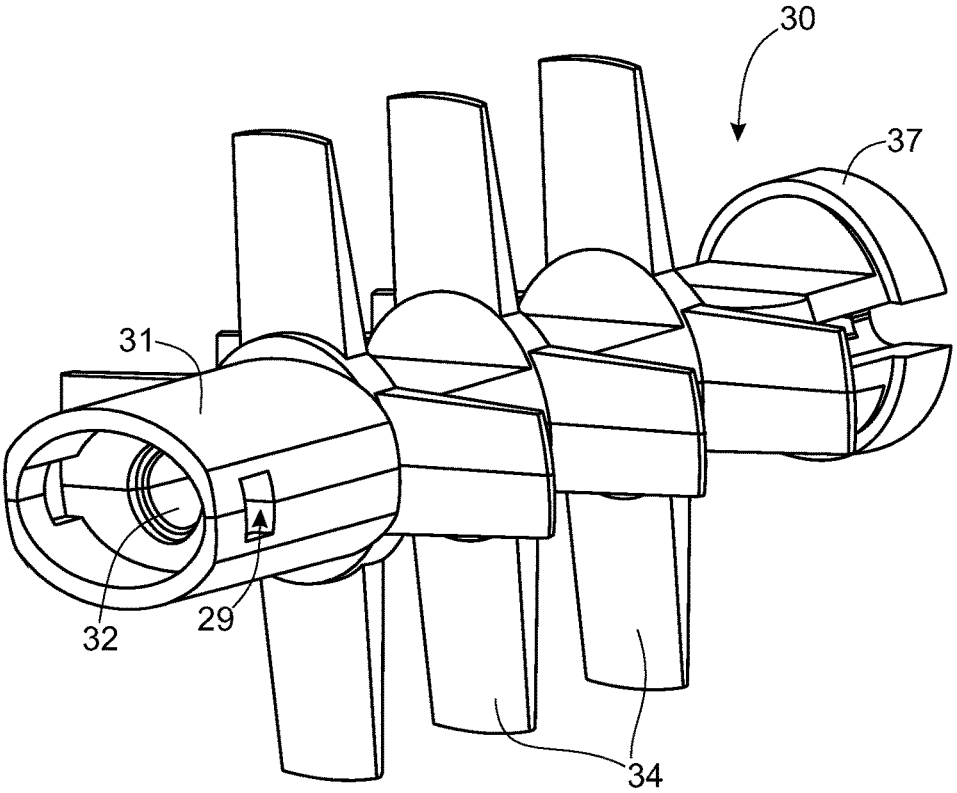
FIG. 6 is a perspective view of the detonator positioning assembly according to an aspect, showing an assembly as if a wired detonator were used.

The detonator assembly 10 is configured to be electrically contactingly received within the detonator positioning assembly 30, in which an embodiment is depicted in FIGS. 4-6, which is seated or positioned within the perforating gun assembly 40, without using the wired electrical connection. In an embodiment, the perforating gun assembly 40 is a modular assembly as discussed above. The detonator positioning assembly 30 is also configured for electrically contactingly receiving the detonator assembly 10 without using the wired electrical connection.

In an embodiment and as shown in FIG. 6, a sleeve 31 extends from one end of the detonator positioning assembly 30. As shown herein, the detonator positioning assembly 30 includes a connecting portion 37 extending from the end opposite the sleeve 31, which is useful in a modular assembly and that would have studs or recesses extending from or recessed into the connecting portion (not shown). The sleeve 31 is configured to receive and hold in place, in at least a semi-fixed position, the detonator head 18 of the detonator assembly 10. As used herein, "hold" means to enclose within bounds, to limit or hold back from movement or to keep in a certain position. As shown herein, the detonator positioning assembly 30 includes a portion that extends from the sleeve 31 in which a wire-receiving hole 29 is provided for insertion of electrical wires extending along the length of the perforating gun assembly. With reference again to FIG. 6, also shown are directional locking fins 34 engageable with corresponding complementarily-shaped structures 47 housed within the perforating gun housing 42, upon a rotation of a top connector (not shown), to lock a position of the top connector along the length of the carrier 42, as more fully described in the Canadian Application.

With particular reference to FIG. 4, the detonator positioning assembly 30 is positioned within the perforating gun assembly 40 and functions to receive and hold in place the detonator assembly 10 according to an aspect. In addition, the detonator positioning assembly 30 also functions to provide electrical contacting components for wirelessly-connectably electrically receiving the detonator assembly 10 as will be discussed in greater detail below.

The detonator positioning assembly 30 abuts and connects or snap-fits to grounding means, depicted herein as the gun body or barrel or carrier or housing 42, for grounding the detonator assembly 10. A tandem seal adapter 44 is configured to seal inner components within the perforating gun housing 42 from the outside environment using sealing means. The tandem seal adapter 44 seals adjacent perforating gun assemblies (not shown) from each other, along with a bulkhead assembly 46.

The bulkhead assembly 46 functions to relay a line-in contact-initiating pin 38 for wirelessly electrically contacting the line-in portion 20 of the detonator head 18.

Turning again to the detonator positioning assembly 30, in a preferred embodiment, the sleeve 31 includes a recessed portion 32 that includes an opening on one end and a base on the opposite end of the recessed portion. Preferably, the sleeve 31 also includes a bore 33 positioned at the base, more preferably in the center of the base of the recessed portion 32. The bore 33 extends within and along at least a portion of a length of the detonator positioning assembly 30 such that when the detonator assembly 10 is positioned within the sleeve 31, the detonator shell 12 is positioned in the bore 33.

In an embodiment, the recessed portion 32 and the detonator head 18 are complementarily sized and shaped to receive and seat/be received and seated, respectively, in at least a semi-fixed position within the detonator positioning assembly 30.

In yet another embodiment, the sleeve 31 includes a line-out contact-receiving portion 36 configured for electrically contactingly engaging the line-out portion 22 of the detonator head 18 to form a first electrical connection. In other words, the electrical connection is made only by contact with the line-out portion of the detonator head 18 . . . that is by merely physically touching.

Preferably, a line-in contact-initiating pin 38 is provided and configured for electrically contactingly engaging the line-in portion 20 of the detonator head 18 to form a second electrical connection, and the ground portion 13 is configured for electrically contactingly engaging an inner wall or surface of the gun carrier 42, otherwise referred to as a ground contact-receiving portion 39, to form a third electrical connection. The connection is made, in this embodiment, via an integral ground connection in the detonator positioning assembly 30 and the locking fins 34. In an embodiment, the detonator positioning assembly 30 and the locking fins 34 may be made from conductive material. Thus, when the detonator assembly 10 is positioned within the detonator positioning assembly 30, the first, second and third electrical connections are completed without using a wired electrical connection. In an embodiment, the line-out contact-receiving portion 36 is positioned at the base of the recessed portion 32 of the sleeve 31.

In an embodiment, the line-in contact-initiating pin 38, the line-out contact-receiving portion 36 and the ground contact-receiving portion 39, as well as the line-in portion 20, the line-out portion 22 and the ground portion 13 are physically isolated from each other.

In an embodiment, a through wire 35 extends between the line-out contact-receiving portion 36 of the perforating gun assembly 40 to an adjacent perforating gun assembly in a multiple gun arrangement or train.

In an embodiment, a detonating cord 48 is positioned within the detonator positioning assembly 30, adjacent to the bore 33, such that at least a portion of the detonating cord 48 is in side-by-side contact with at least a portion of the detonator shell 12 at the end opposite the detonator head 18.

In operation and in an embodiment, the ignition signal I is received by the detonator assembly 10, which ignites the detonating cord 48, which in turn ignites each of the charge(s) 50 attached to the detonating cord. Transmission of the signal I is conducted along the through wire 35, without the need to manually connect the through wire 35 to the detonator assembly 10, that is, without using a wired electrical connection, while the electrical contacts are completed upon placement of the detonator assembly 10 into the detonator positioning assembly 30.

According to an aspect, a method of assembling the perforating gun assembly 40 without using a wired electrical connection is also provided. The method includes the steps of positioning the detonator positioning assembly 30 within the perforating gun assembly 40 and positioning a wirelessly-connectable selective electronic detonator assembly 10 within the detonator positioning assembly 30. In yet another embodiment, the method includes assembling a modular perforating gun assembly and the method includes frictionally fitting or snap-fitting components together.

The components and methods illustrated are not limited to the specific embodiments described herein, but rather, features illustrated or described as part of one embodiment can be used on or in conjunction with other embodiments to yield yet a further embodiment. It is intended that all such modifications and variations are included. Further, steps described in the method may be utilized independently and separately from other steps described herein.

While the device and method have been described with reference to a preferred embodiment, it will be understood by those skilled in the art that various changes may be made and equivalents may be substituted for elements thereof without departing from the intended scope. In addition, many modifications may be made to adapt a particular situation or material to the teachings found herein without departing from the essential scope thereof.

In this specification and the claims that follow, reference will be made to a number of terms that have the following meanings. The singular forms "a," "an" and "the" include plural referents unless the context clearly dictates otherwise. Furthermore, references to "one embodiment," "an embodiment," and the like are not intended to be interpreted as excluding the existence of additional embodiments that also incorporate the recited features. Terms such as "first," "second," etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of."

Advances in science and technology may make equivalents and substitutions possible that are not now contemplated by reason of the imprecision of language; these variations should be covered by the appended claims. This written description uses examples to disclose the device and method, including the best mode, and also to enable any person of ordinary skill in the art to practice the device and method, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A wireless detonator assembly configured for being electrically contactably received within a perforating gun assembly without using a wired electrical connection, comprising:

a shell configured for housing components of the detonator assembly;

more than one electrical contact component, wherein at least one of the electrical contact components extends from the shell and further wherein the electrical contact component comprises an electrically contactable line-in portion, an electrically contactable line-out portion and an electrically contactable ground portion, the ground portion in combination with the line-in portion and the line-out portion being configured to replace the wired electrical connection to complete an electrical connection merely by contact;

an insulator positioned between the line-in portion and the line-out portion, wherein the insulator electrically isolates the line-in portion from the line-out portion; and means for selective detonation housed within the shell, wherein the detonator assembly is configured for electrically contactably forming the electrical connection merely by the contact.

2. The wireless detonator assembly of claim 1, wherein the means for selective detonation further comprise an electronic circuit board and means for receiving an ignition signal.

3. The wireless detonator assembly of claim 2, further comprising a capacitor positioned on the electronic circuit board, the capacitor configured to be discharged to initiate the detonator assembly upon receipt of a digital firing sequence via an ignition signal, the ignition signal being electrically relayed directly through the line-in portion and the line-out portion.

4. The wireless detonator assembly of claim 2, further comprising means for ensuring immunity to stray current or voltage or radio frequency signals, such that the detonator assembly is not unintentionally armed or initiated.

5. A perforating gun assembly, comprising:

a wirelessly-connectable selective detonator assembly configured for being electrically contactably received within the perforating gun assembly without using a wired electrical connection, the detonator assembly comprising:

a shell configured for housing components of the detonator assembly;

more than one electrically contactable component, wherein at least one of the electrical contact components extends from the shell and further wherein the electrical contact component comprises an electrically contactable line-in portion, an electrically contactable line-out portion, and an electrically contactable ground portion, the ground portion in combination with the line-in portion and the line-out portion being configured to replace the wired electrical connection to complete an electrical connection merely by contact;

an insulator positioned between the line-in portion and the line-out portion, wherein the insulator electrically isolates the line-in portion from the line-out portion; and means for selective detonation of the detonator assembly, wherein the means for selective detonation is housed within the shell, and the detonator assembly configured for electrically contactably forming the electrical connection merely by the contact and without the need of manually and physically connecting wires.

6. The perforating gun assembly of claim 5, wherein the means for selective detonation further comprise an electronic circuit board and means for receiving an ignition signal.

7. The perforating gun assembly of claim 6, further comprising a capacitor positioned on the electronic circuit board, the capacitor being configured to be discharged to initiate the detonator assembly upon receipt of a digital firing sequence via an ignition signal, and the ignition signal being electrically relayed directly through the line-in portion and the line-out portion.

8. The perforating gun assembly of claim 5, further comprising a detonating cord positioned within the perforating gun assembly such that at least a portion of the detonating cord is in contact with the detonator assembly.

9. The perforating gun assembly of claim 8, wherein the detonator assembly is configured for initiating the detonating cord without the detonating cord having to be attached to the detonator assembly.

10. The perforating gun assembly of claim 8, wherein the detonating cord is positioned in side-by-side contact with at least a portion of the shell.

11. The perforating gun assembly of claim 5, further comprising means for ensuring immunity to stray current or voltage or radio frequency signals, such that the detonator assembly is not unintentionally armed or initiated.

12. A method of assembling a perforating gun assembly without using a wired electrical connection, comprising:

positioning a wirelessly-connectable selective detonator assembly within the perforating gun assembly, wherein the detonator assembly comprises:

a shell configured for housing components of the detonator assembly;

more than one electrically contactable component, wherein at least one of the electrical contact components extends from the shell and further wherein the electrical contact component comprises an electrically contactable line-in portion, an electrically contactable line-out portion, and an electrically contactable ground portion, the ground portion in combination with the line-in portion and the line-out portion being configured to replace the wired electrical connection to complete a wireless electrical connection merely by contact;

an insulator positioned between the line-in portion and the line-out portion, wherein the insulator electrically isolates the line-in portion from the line-out portion; and means for selective detonation of the detonator assembly, electrically contactingly connecting the detonator assembly such that the detonator assembly electrically contactably forms the wireless electrical connection merely by the contact and without the need of manually and physically connecting wires.

13. The method of assembling the perforating gun assembly of claim 12, further comprising:

positioning a detonator positioning assembly within the perforating gun assembly; and positioning the wirelessly-connectable selective detonator assembly within the detonator positioning assembly.

14. The method of assembling the perforating gun assembly of claim 12, further comprising:

positioning a detonating cord within the perforating gun assembly such that at least a portion of the detonating cord is in contact with the detonator assembly.

15. The method of assembling the perforating gun assembly of claim 14, further comprising:

initiating the detonating cord without the detonating cord having to be attached to the detonator assembly.

* * * * *